United States Patent [19]

Killmann

[11] Patent Number: 4,509,655

[45] Date of Patent: Apr. 9, 1985

[54] BOTTLE OR SIMILAR CONTAINER, ESPECIALLY FOR READILY COMBUSTIBLE LIQUIDS, WITH A SCREW-ON CLOSURE

[75] Inventor: Peter A. Killmann, Essen, Fed. Rep. of Germany

[73] Assignee: Marsteller & Killman GmbH & Co. KG, Essen, Fed. Rep. of Germany

[21] Appl. No.: 545,962

[22] Filed: Oct. 27, 1983

[30] Foreign Application Priority Data

Jul. 5, 1983 [DE] Fed. Rep. of Germany ..... 3324097

[51] Int. Cl.[3] ..... B65D 47/14

[52] U.S. Cl. ..... 215/309; 222/484

[58] Field of Search ..... 215/309; 222/484

[56] References Cited

U.S. PATENT DOCUMENTS 1,525,032 2/1925 Grady ..... 222/484

2,440,112 4/1948 Nellson ..... 222/484

3,739,938 6/1973 Paz ..... 215/309 X

*Primary Examiner*—Donald F. Norton

*Attorney, Agent, or Firm*—Max Fogiel

[57] ABSTRACT

Bottle or similar container, especially for readily combustible liquids, with a screw-on closure. There is an insert in the neck of the container with two parallel openings through it. One is a liquid outlet and the other an air inlet. The air inlet is extended by a tubular projection that is oriented inward and liquid outlet a tubular projection that is oriented outward. Each of the openings can be closed off from inside the container with a separate plug, one plug being rigidly attached to the other. The plug that is associated with the air inlet is extended by a bolt that passes through it. The bolt is loaded with a spring in such a way that the plugs automatically close off both openings. A stopper is screwed into the neck of the container and has an external annular shoulder that rests on the upper edge of the neck.

6 Claims, 1 Drawing Figure

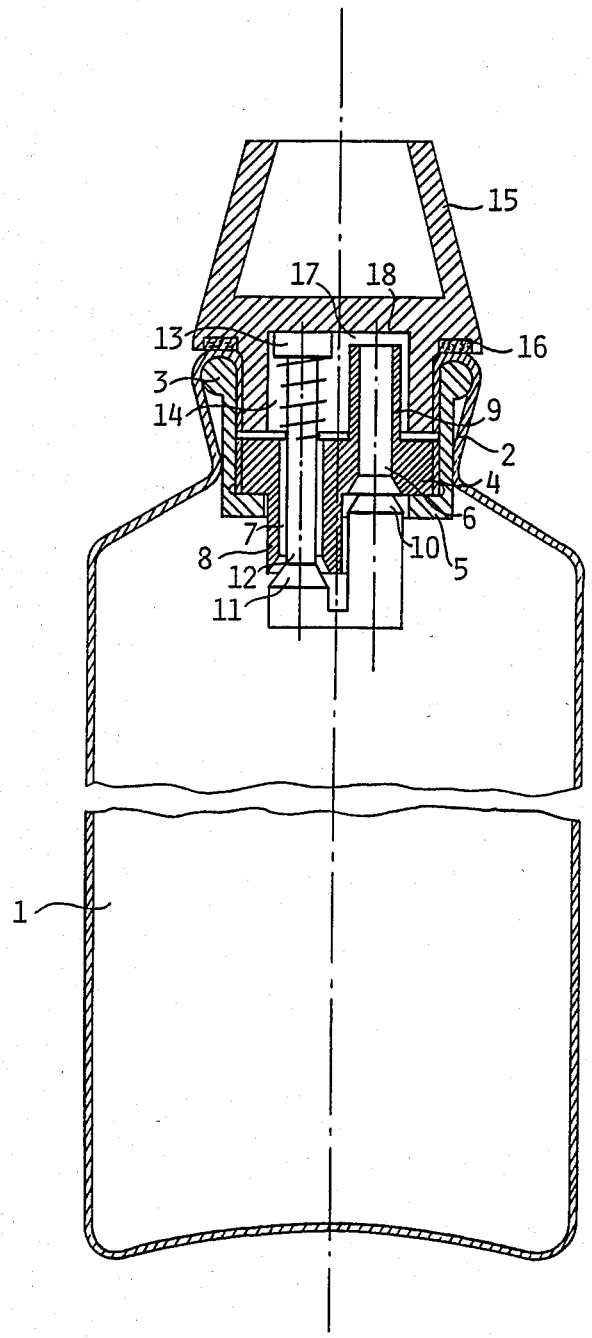
15
17
18
13
16
3
14
9
2
4
6
7
10
8
5
12
11
1

BOTTLE OR SIMILAR CONTAINER, ESPECIALLY FOR READILY COMBUSTIBLE LIQUIDS, WITH A SCREW-ON CLOSURE

BACKGROUND OF THE INVENTION

The present invention relates to a bottle or similar container, especially for readily combustible liquids, with a closure that has two openings that can be closed off, one a liquid outlet and the other an air inlet.

A known closure is of the screw-on type. It is intended to facilitate fueling small combustion devices like camping stoves, barbecue grills, etc. It has two openings that open when the closure is unscrewed about halfway. It has one disadvantage, however. The closure cannot be locked into the halfway-unscrewed position. The danger is that it can get unscrewed too far and drop out while the liquid, fuel, is being poured out. Precisely measured amounts of liquid cannot be directed at the combustion site and the fuel can spill. This is especially dangerous when fuel is to be poured into devices that are already lit. The device can flare up and flame can even flash back up into the fuel container.

SUMMARY OF THE INVENTION

The object of the present invention is a container that can be sealed absolutely tight with a screw-on closure while the liquid is being stored or transported and that the liquid can be poured out of in a slender and precisely measured stream but only while an automatically closing valve is being activated.

This object is attained in accordance with the invention because (a) there is an insert in the neck of the container with two parallel openings through it, one a liquid outlet and the other an air inlet, (b) the liquid outlet is extended by a tubular projection that is oriented outward, (c) each of the openings can be closed off from inside the container with a separate plug, one plug being rigidly attached to the other, (d) the plug that is associated with the air inlet has a bolt that is rigidly attached to it, that passes through it leaving a certain amount of play, and that is loaded with a spring in such a way that both plugs are forced against the openings, (e) the free end of the bolt projects far enough out of the air inlet to function as a button that can be activated to open valves constituted by the openings and plugs, (f) a stopper is screwed into the neck of the container and has an external annular shoulder that rests on the upper edge of the neck or on a part that is tightly connected to the neck, and (g) the stopper has a recess that opens toward the inside of the container and into which the activating button and the tubular projection on the liquid outlet extend.

In one particularly practical embodiment of the invention the bolt is forced down by the ceiling of the recess in the stopper when the stopper is screwed on tight so that the valves are open. There is an advantage to this design. The valves will remain open when the stopper is slightly unscrewed. Any excess pressure that builds up in the container can be relieved through tolerances in the threading of the stopper or through specially introduced grooves. The liquid will accordingly not spurt out when the liquid outlet is initially unblocked.

In another practical embodiment the air inlet in the insert is extended with a projection oriented into the container. The liquid will accordingly exit only through the liquid outlet and not through the air inlet, even when the container is completely inverted. Since the projection is oriented into the container, the column of liquid above the outlet when the container is inverted will be higher than that above the air inlet. This design ensures that air will enter the container only through the air inlet because the pressure above it is lower.

In still another practical embodiment of the invention an internally threaded bushing is positioned in the neck of the container and the insert screwed into the bushing all the way up to a stop. This design facilitates positioning the insert, already provided with valves, in the neck of the container without risk of damage. It also allows valves to be replaced in the neck.

It is practical for the threaded bushing in the neck of a metal container to have a bead and for the stopper to be designed so that its external annular shoulder will rest on the upper edge of the neck. Beading is a rapid and reliable operation. It may nevertheless be impossible to always guarantee that a stopper of this type will be tight enough for storage and transport, and a supplementary stopper may have to be employed.

BRIEF DESCRIPTION OF THE DRAWING

A preferred embodiment of the invention will now be described with reference to the attached drawing, which is a sectional elevational view.

DESCRIPTION OF THE PREFERRED EMBODIMENT

A bottle or container 1 has a neck 2 at the top. An internally threaded bushing 3 is beaded into neck 2. An insert 4 is screwed into threaded bushing 3 as far as an inside flange 5 that functions as a stop. Insert 4 has two parallel openings, one of which is a liquid outlet 6 and the other an air inlet 7. Air inlet 7 has a tubular projection 8 oriented toward the inside of the container and liquid outlet 6 an outwardly oriented tubular extension 9.

Liquid outlet 6 is closed off from inside the container by a plug 10 and air inlet 7 by a plug 11. The two plugs 10 and 11 are in one piece. Each plug constitutes a valve in conjunction with the bottom edge of liquid outlet 6 and of air inlet 7. The valves can be activated with a bolt 12 that is cast onto plug 11 and passes through air inlet 7. The upper end of bolt 12 is wider and functions as an activating button 13. A compression spring 14 is inserted between activating button 13 and the upper edge of air inlet 7. The stress of spring 14 keeps the valves closed. Pressing down on activating button 13 with the finger against the force of spring 14 will open both valves.

A stopper 15 is screwed into threaded bushing 3 to seal off the bead connection of the bushing inside neck 2. An annular shoulder on stopper 15 rests on an intermediate gasket 16 against the upper beaded edge of neck 2.

There is a downward-facing recess 17 in stopper 15. Activating button 13 and the channel-shaped extension 9 on liquid outlet 6 extend into recess 17. Recess 17 is shallow enough for its ceiling 18 to force activating button 13 down against the force of compression spring 14 when stopper 15 is firmly screwed on. This forces plugs 10 and 11 off of their valve seats and keeps the valves open.

When stopper 15 is unscrewed slightly, any pressure that builds up inside the container will escape through the loosened threads between stopper 15 and activating button 13.

I claim:

1. Bottle or similar container, particularly for readily combustible liquids, with a closure comprising: two openings that can be closed off, one a liquid outlet and the other an air inlet, said container having a neck;

(a) an insert in the neck of the container with said two openings therethrough, said openings being parallel, one opening being a liquid outlet for pouring out a liquid and the other opening being an air inlet;

(b) a tubular projection that is oriented outward for extending said liquid outlet;

(c) two separate plugs for closing each opening from inside the container, one plug being rigidly attached to the other;

(d) a bolt rigidly attached to the plug associated with said air inlet, said bolt passing through said air inlet with a predetermined amount of play; spring means on said bolt for forcing both plugs against said openings;

(e) said bolt having a free end projecting out of said air inlet for functioning as a button that can be activated to open valves comprised by said openings and plugs;

(f) a stopper screwed into the neck of the container and having an external annular shoulder resting on the neck;

(g) said stopper having a recess opening toward the inside of the container, said button and said tubular projection on said liquid outlet extend into said recess.

2. Container as defined in claim 1, wherein said bolt is forced down by a ceiling of said recess in said stopper when said stopper is screwed on tight, so that the valves are open.

3. Container as defined in claim 1, wherein said air inlet in said insert is extended with a projection oriented into the container.

4. Container as defined in claim 1, and an internally threaded bushing positioned in the neck of the container, said insert being screwed into said bushing up to a stop.

5. Container as defined in claim 4, and comprised of metal, said threaded bushing in the neck having a bead, said stopper having an external annular shoulder resting on an upper edge of the neck.

6. Container as defined in claim 4, wherein said threaded bushing has an inside flange functioning as a stop for said insert, said insert having screw threads.

* * * * *